United States Patent [19]

Cowell

[11] 4,301,964

[45] Nov. 24, 1981

[54] SWINGING TUBE HOLDER

[75] Inventor: Mark J. Cowell, Mountain View, Calif.

[73] Assignee: Beckman Instruments, Inc., Fullerton, Calif.

[21] Appl. No.: 114,876

[22] Filed: Jan. 24, 1980

[51] Int. Cl.[3] ..... B04B 15/00; B04B 9/12

[52] U.S. Cl. ..... 233/26; 211/74

[58] Field of Search ..... 233/26, 1 R; 211/74–77; 366/213, 214

[56] References Cited

U.S. PATENT DOCUMENTS

| | | | |
|---|---|---|---|
| 3,361,343 | 1/1968 | Lerner | 233/26 |
| 3,387,810 | 6/1968 | Sakier | 211/74 X |
| 3,687,359 | 8/1972 | Scanlon | 233/26 |
| 3,709,429 | 1/1973 | McKenzie et al. | 233/26 |
| 3,747,842 | 7/1973 | Grubb et al. | 233/26 |

*Primary Examiner*—Philip R. Coe

*Attorney, Agent, or Firm*—R. J. Steinmeyer; F. L. Mehlhoff; William H. May

[57] ABSTRACT

A centrifuge tube holder designed for use in a centrifuge rotor to hold a plurality of small volume tubes in such a manner that, when the centrifuge rotor is at rest, the tubes will be oriented at an inclined angle, but will assume essentially a horizontal orientation when the centrifuge rotor is operating. The holder provides improved collar support for the centrifuge tube during centrifugation and also provides for the inclusion of a tube pivot point in the plate to enhance the proper movement of the tube from its at-rest position to the correct support position during operational speeds of the centrifuge rotor.

6 Claims, 9 Drawing Figures

SWINGING TUBE HOLDER

BACKGROUND OF THE INVENTION

The present invention is directed to a centrifuge tube adapter or holder designated to carry a plurality of small volume tubes within a centrifuge rotor and, more particularly, is directed to a holder which permits the tubes to pivot from an inclined angle when the rotor is at rest to a horizontal orientation when the rotor is operational.

In certain clinical tests or experiments, it is desirable to place a large number of separate individual samples in a plurality of very small volume centrifuge tubes for placement in a specific centrifugation run to obtain the desired separation within the sample. Therefore, in order to provide the most efficient use of the centrifuge, it is desirable to place as many of these small volume tubes within a single centrifuge rotor as possible so that each centrifuge run is as efficient as possible. One approach is the placement of a plurality of small volume tubes within the rotor on some type of adapter to hold the tubes in a large rotor for centrifugation.

The problem with previous devices used to handle a plurality of small volume tubes related to the proper orientation of the tubes in the rotor after centrifugation. It is desirable not to have the tubes remain in a horizontal position once the centrifugation has been completed. Some previously designed holders that have been used to support small volume tubes did provide for the desired inclined rest angle, but did not provide the needed support to the upper end or collar of the tube to prevent extrusion of the tube during centrifugation. In other words, it is important that support is provided around as much of the upper end of the tube as possible. Unfortunately, the prior approaches have generally provided support to the collar of the swinging tube on two sides leaving over 180° of the collar portion of the tube unsupported which results in possible deflection or deformity in the tube.

One prior art arrangement incorporates a flat thin plate that has elongated holes into a rotor with a plurality of radially extending sections or arms forming a plurality of yokes. Slots are formed in the opposing arms within a yoke area into which the flat thin plate is positioned. The elongated holes permit pivoting of the tubes, but there is no locating function by the plate of the collar of the tube. Therefore, quite often the collar has significantly less than 180° of support which may cause extrusion of the tube around the collar during high speed centrifugation.

It is also extremely important during the operation of the centrifuge that the tubes be generally free to move between the horizontal and the inclined position depending upon the speed of the centrifuge. Otherwise, the tubes may become askew or caught in the improper position. One reason for problems in this area has been the lack of provision of a proper pivot edge in the holder upon which the tube can rotate or pivot as the centrifuge moves from the rest position to the full operational speed. Similarly, the pivot area is important with respect to the movement of the tube from the operational speed to the rest position.

SUMMARY OF THE INVENTION

The present invention is directed to a uniquely designed centrifuge tube adapter plate for receipt of a plurality of small volume centrifuge tubes wherein the tubes assume an inclined angle with respect to the horizontal when the centrifuge rotor is at rest, but automatically pivot to the horizontal direction when the centrifuge rotor is at operational speed.

The present invention tube adapter plate allows for the free pivoting or movement of the small volume tubes as the rotor is moving from its rest position to full operational speed, as well as when the rotor is moving from its full operational speed to its rest position. An important feature to the present invention to enhance this proper pivotal movement of the tube is the utilization of a built-in pivot edge which acts as a pivot for the tube and operates in conjunction with centrifugal forces to promote the proper movement of the tube to its correct and specific support location. By having this pivot incorporated within the adapter, the support area is essentially fixed for the tube as it moves into position during centrifugation.

The support area for the tube in the adapter plate of the present invention is greatly increased over the designs of previous tube holders or adapter plates for small volume centrifuge tubes. Typically, the support area found on the present invention is over 180° of the support collar on the tube. This is extremely important in that it provides more distribution in the support of the tube during centrifugation and tends to prevent any extrusion or deformity in the tube caused by the centrifugal forces during centrifugation.

DETAILED DESCRIPTION OF THE PRESENT INVENTION

Figure 1:
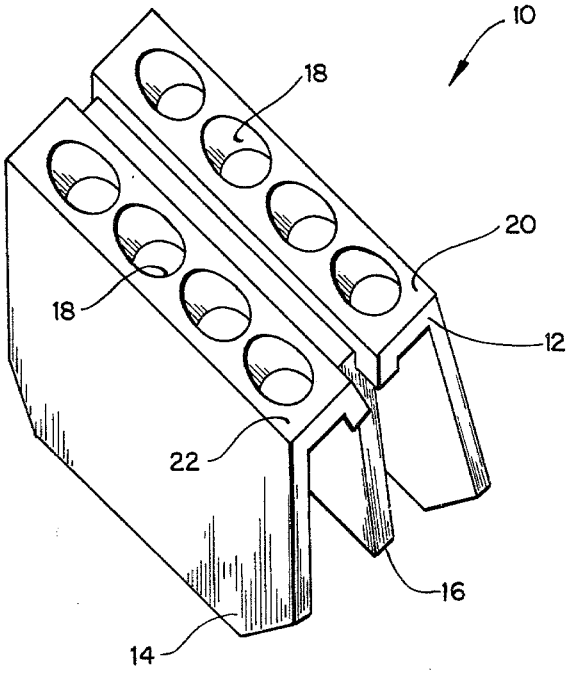
FIG. 1 is a perspective view of the holder device.

The holder device 10 shown in FIG. 1 is similar to the arrangements shown in my copending application Ser. No. 93,725 entitled CENTRIFUGE TUBE HOLDER filed on Nov. 13, 1979. The two support sections 12 and 14 are pivotally connected to a central support 16. The centrifuge tubes are placed in a plurality of holes 18 in the top portions or panels 20 and 22 of the respective support sections 12 and 14. The combination of the central support 16 and the two support sections 12 and 14 carry and support centrifuge tubes when in the rotor and when on the work table in the manner described in my above referenced patent application.

Figure 2:
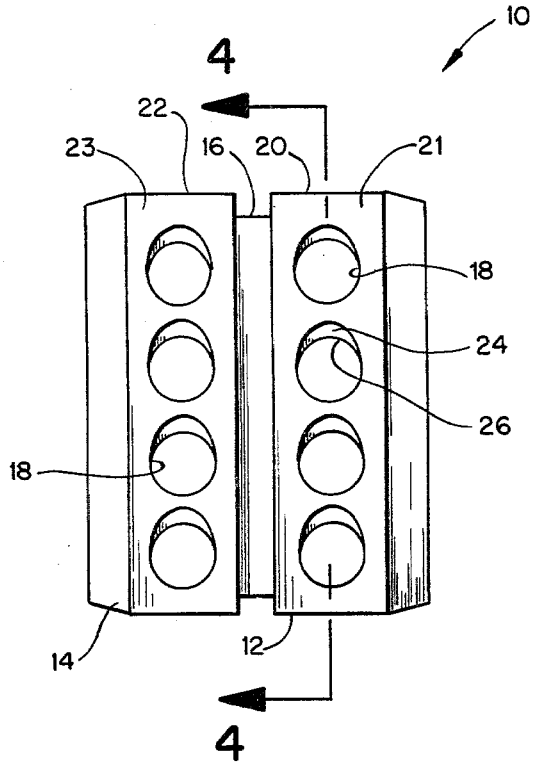
FIG. 2 is a front elevational view of the holder.

The holder 10 in FIG. 2 has a plurality of apertures 18, each of which is designed to receive a small volume centrifuge tube designed to hold approximately 1.5 ml. As shown with respect to FIG. 4, the holder 10 has a relatively small depth or thickness and is preferably made of hard plastic-type material. A generally semicircular tapered area 24 is formed at the upper end 26 of each of the apertures 18 with respect to FIGS. 2 and 4. This tapered portion extends from the front surfaces 21 and 23 of the panels 20 and 22, respectively, to the upper edge 26 of each of the apertures. The taper as shown in FIG. 4 is approximately 45° with respect to the horizontal reference A.

Figure 3:
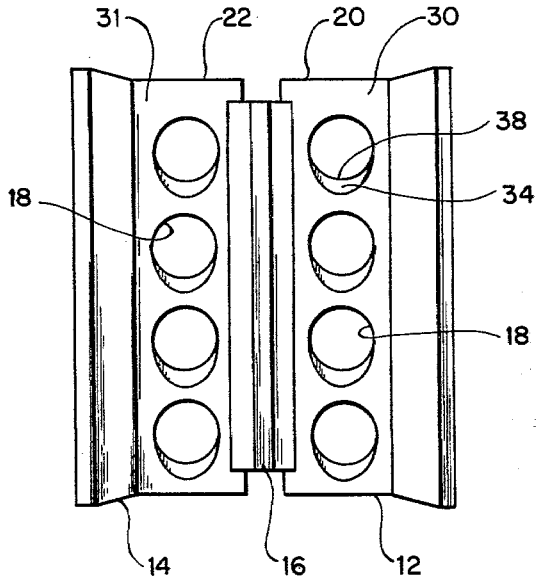
FIG. 3 is a rear or back elevational view of the holder.
Figure 4:
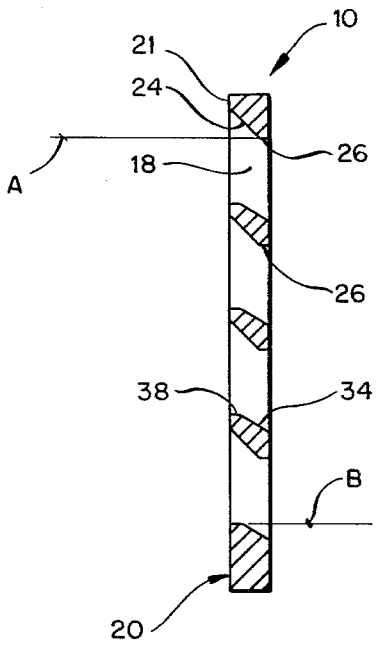
FIG. 4 is a sectional view taken along the lines 3—3 in FIG. 2.

Also, as shown with respect to FIGS. 3 and 4, a generally semicircular tapered portion 34 for each of the apertures 18 is located on the back surfaces 30 and 31 of the panels 20 and 22 and extends from the back surface 30 of the holder to the bottom part 38 of each of the apertures 18. The incline with respect to the tapered area 34 on the back surface 30 of the panel 20 is approximately 30° with respect to the horizontal B as shown in FIG. 4. Each of the apertures has an upper horizontal area or ledge portion 26 and a lower horizontal area or ledge portion 38.

Figure 5:
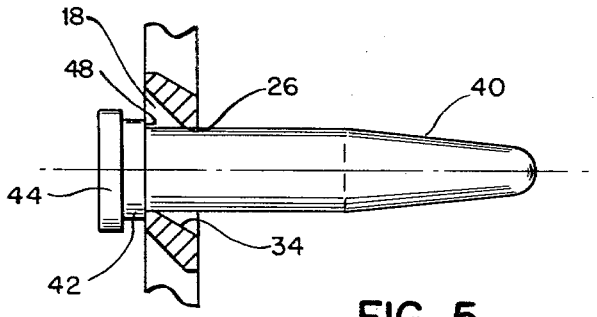
FIG. 5 is a partial sectional view similar to FIG. 5 with the centrifuge tube shown in its orientation when the rotor is at operational speed.
Figure 6:
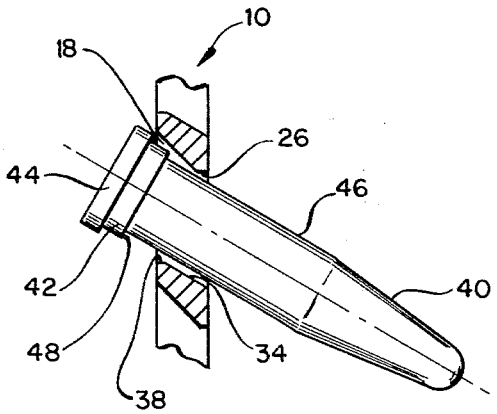
FIG. 6 is a partial sectional view of the holder showing the tube orientation when the centrifuge rotor is at rest.

As shown in FIG. 6, a centrifuge tube 40 with its support collar 42 and cap portion 44 is inserted into one of the apertures 18 within the holder 10. When the holder 10 is positioned vertically in a rotor which is stationary, the tube will orient at approximately 30° with respect to the horizontal, since the side surface 46 of the tube 40 will be oriented with the lower tapered portion 34 in the aperture 18. As the centrifuge rotor is moved from the rest position to the operational speed of the centrifuge, the tube 40 will pivot to the horizontal position shown in FIG. 5. The upper horizontal surface 26 within each of the apertures 18 will provide a pivot edge around which a tube will pivot to automatically find its proper support orientation for the collar 42 of the tube. It should be noted that the shoulder area 48 of the collar 42 will find support on the front surface 21 and 23 of the respective panels 20 and 22 around the aperture 18.

Figure 7:
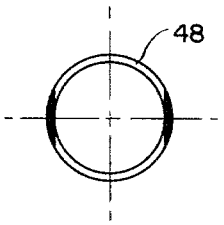
FIG. 7 is a schematic sketch of the centrifuge tube collar showing the area supported by prior art holder support mechanisms.
Figure 8:
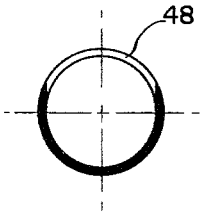
FIG. 8 is a schematic sketch of a tube collar showing the portion which is supported by the tube holder of the present invention.

Because of the unique design of the present invention, the support of the holder for the shoulder 48 of the tube will always be well over 180° around the collar of the tube as shown in the shaded portion of FIG. 8. Therefore, the support is distributed around a major portion of the collar of the tube and will prevent any type of extrusion or deformity in the tube when subjected to the high forces induced by centrifugation. Prior approaches for establishing a holder device to carry a plurality of small volume tubes had a significantly smaller area of the collar supported during centrifugation and, therefore, caused the tube to be possibly subjected to deformation because of the high stress exerted at the relatively small support area. This was because in the pivoting of the tube in previous arrangements the tube would randomly find its equilibrium position which resulted in less support to the tube. FIG. 7 shows in shaded areas the much smaller support areas that were established in prior types of adapter devices for the small volume tubes.

The important aspect of the present invention is the location of the pivot edge 26 with respect to the support surface on the front surfaces 21 and 23 of the holder panels 20 and 22, respectively. The pivot edge 26 during centrifugation directs or forces the tube into its prior support location so that the support shown in FIG. 8 is achieved around the collar of the tube.

Figure 9:
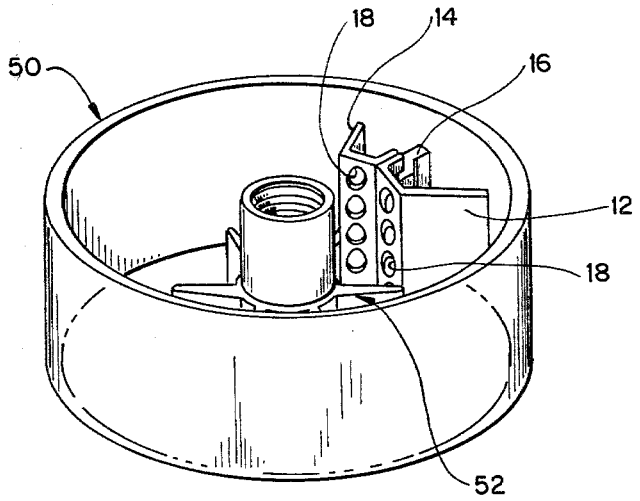
FIG. 9 shows the tube holder in position within a bowl rotor.

FIG. 9 shows the placement of the tube holder 10 in a bowl rotor 50 to provide support for the centrifuge tubes during high speed centrifugation. The rotor 50 is designed to carry a plurality of tube holders 10. A spacer 52 in the rotor 50 properly positions each holder 10 within the rotor.

What is claimed is:

1. A centrifuge rotor tube holder comprising:

an elongagted panel having a specified thickness for placement within a rotor and having a front surface and a back surface with at least one aperture through said panel for receipt of a centrifuge tube;

a first semicircular tapered portion at a specified slope through said aperture along said thickness of said aperture from said front surface toward said back surface; and a second semicircular tapered portion at a specified slope through said aperture along said thickness of said aperture from said back surface toward said front surface, said first and second semicircular tapered portions being on opposite halves of said aperture, when viewing said front surface of said panel perpendicular to said aperture, said second semicircular tapered portion not being visible, said tapered portions in combination with each other within said aperture forming a tapered aperture so that said tube will assume a slanted orientation when placed in said aperture when said rotor is at rest, said tube pivoting within said panel to a position perpendicular to rotor spin axis when said rotor is operating.

2. A centrifuge rotor tube holder as defined in claim 1 and additionally comprising:

a pivot edge for said tube integrally formed adjacent said aperture, said tube automatically pivoting around said pivot edge in response to centrifugally induced forces.

3. A centrifuge rotor tube holder as defined in claim 1, and additionally comprising a semicircular ledge portion adjacent said front surface and a second semicircular ledge portion adjacent said back surface, each of said ledge portions being semicylindrical surfaces generally perpendicular to said front surface, said ledge portions defining a circular opening in said support member when viewed perpendicular to said front surface.

4. A centrifuge rotor tube holder as defined in claim 3, wherein one of said semicircular ledge portions comprises a pivot edge for properly positioning said tube as it pivots from an inclined position to a horizontal position so that more than half of the collar of said tube is supported on said front surface.

5. A centrifuge rotor tube holder assembly comprising:

a support panel for placement within a rotor and having at least one aperture from one surface to another surface of said panel for receipt of a centrifuge tube having a collar larger than said aperture;

a first tapered portion adjacent said aperture from said one surface to said other surface of said support panel, said first tapered portion making an enlarged opening of said aperture on said one surface, said first tapered portion mating with the circumference of said aperture on said other surface; and a second tapered portion adjacent said aperture from said other surface to said one surface of said support panel, said second tapered portion making an enlarged opening of said aperture on said other surface, said second tapered portion mating with the circumference of said aperture on said one surface, the edge of said aperture on said one surface supporting more than one-half the circumference of said collar of said tube so that said tube will be supported enough to prevent extrusion of said tube during high speed centrifugation.

6. A centrifuge rotor holder assembly for pivotal support of centrifuge tubes, said assembly comprising:

a support member having a plurality of apertures through said support member from one surface to another surface of said support member;

a first tapered portion adjacent said aperture from said one surface to said other surface of said support member, said first tapered portion making an enlarged opening of said aperture on said one surface, said first tapered portion mating with the circumference of said aperture on said other surface; and a second tapered portion adjacent said aperture from said other surface to said one surface of said support member, said second tapered portion making an enlarged opening of said aperture on said other surface, said second tapered portion mating with the circumference of said aperture on said one surface, said first and second tapered portions being generally equal in size and tapered in the same direction on opposite halves of said aperture so that, when said tube is placed within said aperture and said support member is vertically oriented in a stationary rotor said tube will assume an inclined position with respect to horizontal, when said rotor is spinning, said tube will pivot within said apertures to assume a horizontal orientation with the longitudinal axis of the tube perpendicular to the spin axis of the rotor.

* * * * *

UNITED STATES PATENT AND TRADEMARK OFFICE

CERTIFICATE OF CORRECTION

PATENT NO. : 4,301,964

DATED : November 24, 1981

INVENTOR(S) : Mark J. Cowell

It is certified that error appears in the above—identified patent and that said Letters Patent is hereby corrected as shown below:

Column 4, line 40, after "portion" insert -- of said aperture --.

Column 4, line 41, after "portion" insert -- of said aperture --.

Signed and Sealed this

Ninth Day of March 1982

[SEAL]

*Attest:*

GERALD J. MOSSINGHOFF

*Attesting Officer*

*Commissioner of Patents and Trademarks*